United States Patent [19]

Leclerc et al.

[11] 4,032,000

[45] June 28, 1977

[54] TRANSPORT DEVICE FOR CYLINDRICAL OBJECTS ROD-SHAPED, SUCH AS CIGARETTES

[75] Inventors: Jean-Francois Leclerc; Henri Anfossi, both of Orleans, France

[73] Assignee: Service d'Exploitation Industrielle des Tabacs et des Allumettes, France

[22] Filed: Apr. 2, 1976

[21] Appl. No.: 673,081

[30] Foreign Application Priority Data

Apr. 4, 1975 France ..... 75.10530

[52] U.S. Cl. ..... 198/428; 198/689

[51] Int. Cl.[2] ..... B65G 47/57

[58] Field of Search ..... 198/20 C, 25, 37, 103, 198/76, 184, 428, 477, 611, 689; 131/21 A, 21 B, 25

[56] References Cited

UNITED STATES PATENTS

| | | | |
|---|---|---|---|
| 2,576,633 | 11/1951 | Naylor | 198/28 |
| 3,437,189 | 4/1969 | Molins | 198/76 X |
| 3,527,234 | 9/1970 | Hinzmann | 131/21 R |
| 3,677,068 | 7/1972 | Schmermund | 131/21 B |
| 3,712,455 | 1/1973 | Anfossi et al. | 198/184 |
| 3,854,567 | 12/1974 | Poupin et al. | 198/20 C |
| 3,901,373 | 8/1975 | Rudzinat | 198/20 C |
| 3,913,724 | 10/1975 | Verjux | 198/20 C |
| 3,952,854 | 4/1976 | Selonke et al. | 198/20 C |
| 3,957,152 | 5/1976 | Heitmann | 198/20 C |

FOREIGN PATENTS OR APPLICATIONS

| | | | |
|---|---|---|---|
| 1,049,283 | 1/1959 | Germany | 198/25 |

*Primary Examiner*—Evon C. Blunk
*Assistant Examiner*—Richard K. Thomson

[57] ABSTRACT

Device for the transportation, transversely to their axis, of cylindrical rod-shaped objects such as cigarettes, of the kind comprising an upstream conveyor with sockets in which said objects are lodged, and an ascending downstream conveyor, smooth, arranged such that it maintains the transported objects through suction, a transfer zone being further arranged at the lower end of the downstream conveyor, wherein said zone which widens from downstream to upstream has in its upstream area a width at the time inferior in diameter to that of a cigarette and substantially the same as the latter when measured at the bottom of the socket.

1 Claim, 1 Drawing Figure

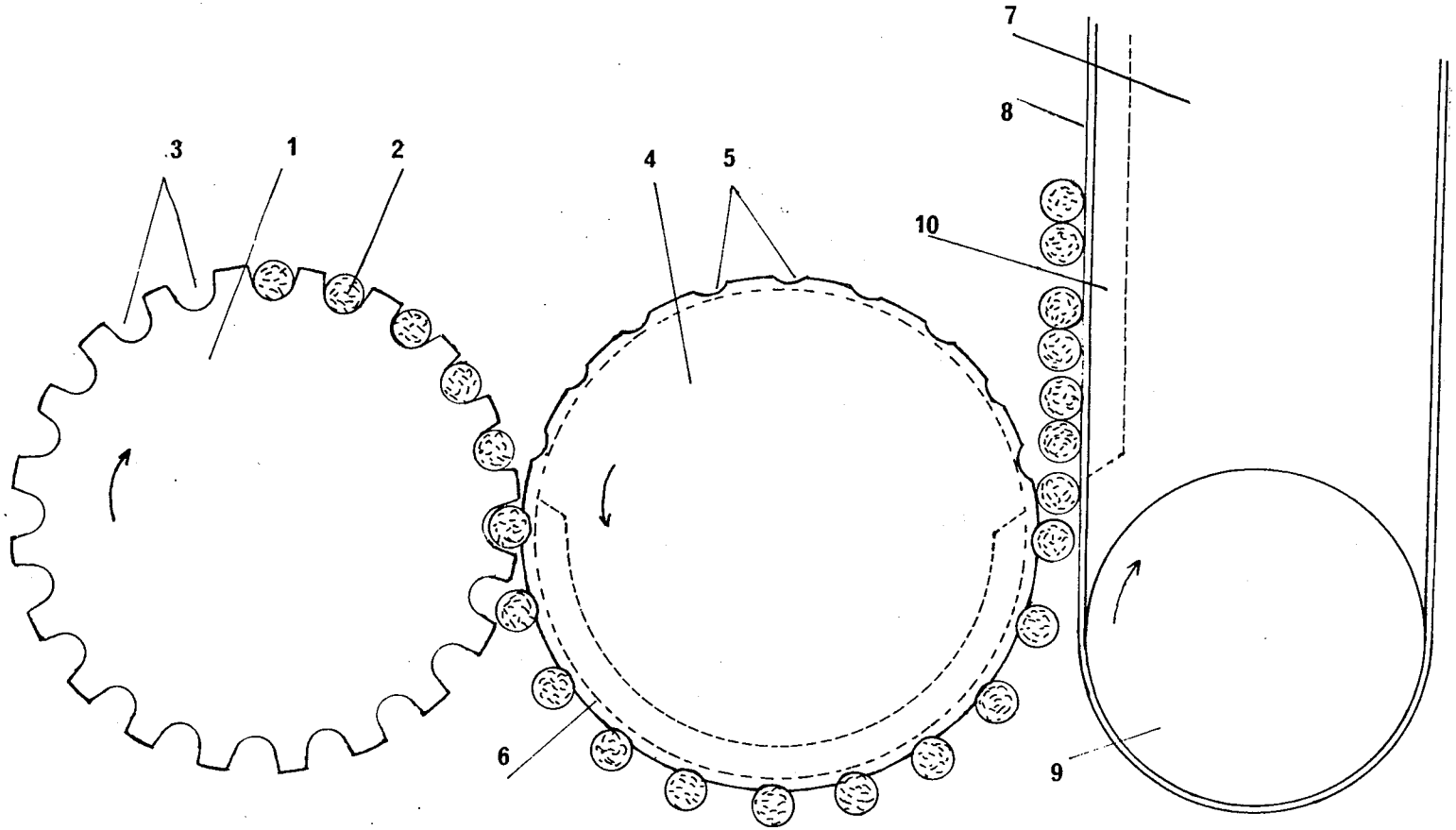
7
8
10
5
4
2
1
3
9
6

TRANSPORT DEVICE FOR CYLINDRICAL OBJECTS ROD-SHAPED, SUCH AS CIGARETTES

The present invention relates to a device to carry along the trajectory of a smooth ascending conveyor, a mono-layer succession of cylindrical objects rod-shaped, such as cigarettes, brought forward transversely to their axis by a first conveyor.

Devices of such kind have already been proposed, wherein the cigarettes brought all close to each other by a first conveyor are taken by a second conveyor through which a suction is exerted. This transfer onto the second conveyor proves possible due to the disposition of the cigarettes adjacent each other.

When the cigarettes are brought by the first conveyor in an isolated way, that is independently from each other, they have to be gathered together so that the second conveyor can take these cigarettes. For this purpose, various means have to be brought into use, which can make the device more delicate to operate.

In order to get rid of this constraint, the present invention provides transfer of the cigarettes from one conveyor to another without the aid of extraneous elements to such device.

The present invention relates also to a device for transportation, transversely to their axis, of cylindrical objects rod-shaped such as cigarettes, of the type comprising a first conveyor, or upstream conveyor, with sockets in which the cigarettes are lodged, and following said upstream conveyor, a second conveyor, or downstream conveyor, which runs upwards and arranged such as to maintain by suction said transported objects. Preferably, the conveyor is smooth and perforated and its internal side communicates, at one part of its run, with a chamber where prevails a depression.

According to the invention, in the lower portion of the downstream conveyor is arranged a transfer zone where the cigarettes coming from the upstream conveyor run onto the downstream conveyor, zone which is characterized in that it grows bigger from upstream to downstream and that its width in its upstream area is at the same time smaller than the diameter of a cigarette and substantially equal to that diameter when measured at the bottom of the socket. Preferably, the sockets of the upstream conveyor communicate with a suction chamber limited to the transfer zone.

The following description, with reference to the unique accompanying drawing which illustrates an embodiment of the device, will render more readily understandable what has been described.

On the only FIGURE, 1 represents the barrel of a cigarette making machine on which cigarettes 2 are received in sockets 3.

Following this barrel 1 of the cigarette making machine, is located a transfer barrel 4 hereabove designated as upstream conveyor.

This barrel is formed with sockets 5 of lesser depth than sockets 3 of barrel 1. Cigarettes 2 are maintained therein due to the effect of a suction applied in a chamber 6 of barrel 4.

Because of the small depth of sockets 5, cigarettes 2 protrude from barrel 4 and can leave the latter more easily.

Following barrel 4 is located an ascending conveyor 7 designated hereabove as downstream conveyor.

This conveyor 7 is formed with an endless belt 8 running around two pulleys, the lower pulley 9 being the only one represented.

This belt 8 is smooth and perforated and its inner side is communicating on part of its run with suction chamber 10.

Between these upstream and downstream conveyors is located the transfer zone at a level where suction chamber 6 stops and where suction chamber 10 begins.

The rotation direction of the various members is indicated by the arrows.

The device operates as follows:

Cigarettes 2 coming from barrel 1 of the cigarette making machine are taken into sockets 5 of transfer barrel 4 where they are maintained due to the suction from chamber 6.

During rotatin of barrel 4, cigarettes 2 reach, separated from each other, the transfer zone in the neighbourhood of conveyor 7.

A cigarette 2 maintained by suction in socket 5 will arrive in a location where suction chamber 6 stops. It will be freed from barrel 4 and will find itself just opposite the beginning of suction chamber 10 of belt 8.

But the suction exerted through the perforations of belt 8 acts only on the generating line of a cigarette; therefore this suction is insufficient to carry it upwards.

Therefore, the cigarettes will have a natural tendancy to slide downwards until the following cigarette freed from the following socket of the barrel joins it and clings to it.

Thus, a group of two adjacent cigarettes will be constituted, which belt 8 will carry upwards owing to the suction.

In the foregoing, the device has been designed with a smooth and perforated downstream conveyor, with suction exerted through the perforations of the conveyor.

But it should be noted that it is also possible to utilize a smooth and unperforated downstream conveyor.

In orer that the device operates, it is sufficient to foresee on either side or on one side only of the downstream conveyor a suction device maintaining the cigarettes stuck to each other and assisting their upward movement by the downstream conveyor.

What we claim is:

1. A device for transporting a plurality of like cylindrical rod-shaped objects such as cigarettes transversely to their longitudinal axis comprising first upstream conveying means and second downstream conveyor means, said first conveying means comprising a cylindrical conveyor having a plurality of like shallow sockets for receiving said objects and said second conveying means comprising a smooth endless belt, said second conveying means being disposed from said first conveying means at a distance such that the length of the shortest perpendicular line from the surface of the second conveying means to the deepest point of the socket is approximately equal to the diameter of the objects, first suction means operable to retain said objects in said sockets over a circumferential portion of said first conveying means which portion terminates approximately in the region of said shortest line, and second suction means operable to retain a pair of said objects contiguously grouped on the ascending portion of said second conveying means which portion begins approximately in the region at which the suction means of said first conveying means terminates.

* * * * *